United States Patent [19]

Garland

[11] Patent Number: 4,457,681

[45] Date of Patent: Jul. 3, 1984

[54] VOLUME RATIO CONTROL MEANS FOR AXIAL FLOW HELICAL SCREW TYPE COMPRESSOR

[75] Inventor: Milton W. Garland, Waynesboro, Pa.

[73] Assignee: Frick Company, Waynesboro, Pa.

[21] Appl. No.: 274,132

[22] Filed: Jun. 16, 1981

[51] Int. Cl.[3] ..... F01C 1/16; F04B 29/00; F15B 13/044

[52] U.S. Cl. ..... 418/201; 417/440

[58] Field of Search ..... 418/201; 417/282, 310, 417/440; 91/459; 200/83 D, 153 K

[56] References Cited

U.S. PATENT DOCUMENTS

| | | | |
|---|---|---|---|
| Re. 29,283 | 6/1977 | Shaw | 418/201 |
| 2,481,646 | 9/1949 | Conklin | 418/189 |
| 2,519,913 | 8/1950 | Lysholm | 418/201 |
| 3,026,809 | 3/1962 | Anderson et al. | 418/159 |
| 3,108,739 | 10/1963 | Nilsson | 418/201 |
| 3,151,806 | 10/1964 | Whitfield | 418/201 |
| 3,665,132 | 5/1972 | May | 200/83 D |
| 3,936,239 | 2/1976 | Shaw | 417/315 |
| 3,977,818 | 8/1976 | Sprankle | 418/201 |
| 4,058,988 | 11/1977 | Shaw | 62/160 |
| 4,140,436 | 2/1979 | Schumacher | 417/440 |
| 4,222,716 | 9/1980 | Shaw | 417/310 |

*Primary Examiner*—Leonard E. Smith
*Assistant Examiner*—Jane E. Obee
*Attorney, Agent, or Firm*—Dowell & Dowell

[57] ABSTRACT

The high pressure end wall of an axial flow helical screw type compressor has a slide member which is movable transversely of the rotors for controlling the size of the discharge passage through the end wall and is controlled by sensing means responsive to the pressure at the end wall and in the discharge area in order that full compression which is substantially equal to the pressure at discharge may be obtained.

4 Claims, 7 Drawing Figures

VOLUME RATIO CONTROL MEANS FOR AXIAL FLOW HELICAL SCREW TYPE COMPRESSOR

FIELD OF THE INVENTION

This invention relates to helical screw type compressors with axial fluid flow in which means is provided for sensing the internal discharge pressure at the discharge end of the rotors and for controlling the size of the discharge opening so that full compression is substantially equal to the pressure of the area to which the fluid is discharged.

DESCRIPTION OF THE PRIOR ART

Axial flow helical screw type compressors are well known in the art. The desirability of substantially equalizing the pressure of fluid being discharged with that of the fluid in the discharge area has been recognized and structure provided for heretofore as in Lysholm U.S. Pat. No. 2,519,913 and Whitfield 3,151,806. More recently, Shaw U.S. Pat. No. Re. 29,283 has a generally similar objective.

The use of axially shiftable slide valves for adjusting the capacity of a screw compressor is disclosed in Schibbye U.S. Pat. No. 3,314,597 and Kocher et al U.S. Pat. No. 3,527,548.

Means for controlling the operation of the slide valve in response to suction or discharge pressure is found in various ones of the above patents.

The patent to Sprankle U.S. Pat. No. 3,977,818 discloses a helical screw type expander having a transversely movable valve member in the high pressure inlet wall for throttling water under high heat and pressure from geothermal streams.

SUMMARY OF THE INVENTION

The present invention is directed to a valve member and control means for controlling the size of the discharge opening in a helical screw type compressor with axial fluid flow in which the high pressure discharge opening is formed in the high pressure end wall and in which control means for the valve member is responsive to pressure at the internal face of the end wall in order to provide variable optimum control of the valve member. The position and shape of the transverse valve member is such as to permit the compressor to incorporate the customary axially movable slide valve member for capacity control which may be operated by means known in the art.

DESCRIPTION OF THE PREFERRED EMBODIMENT

Figure 1:
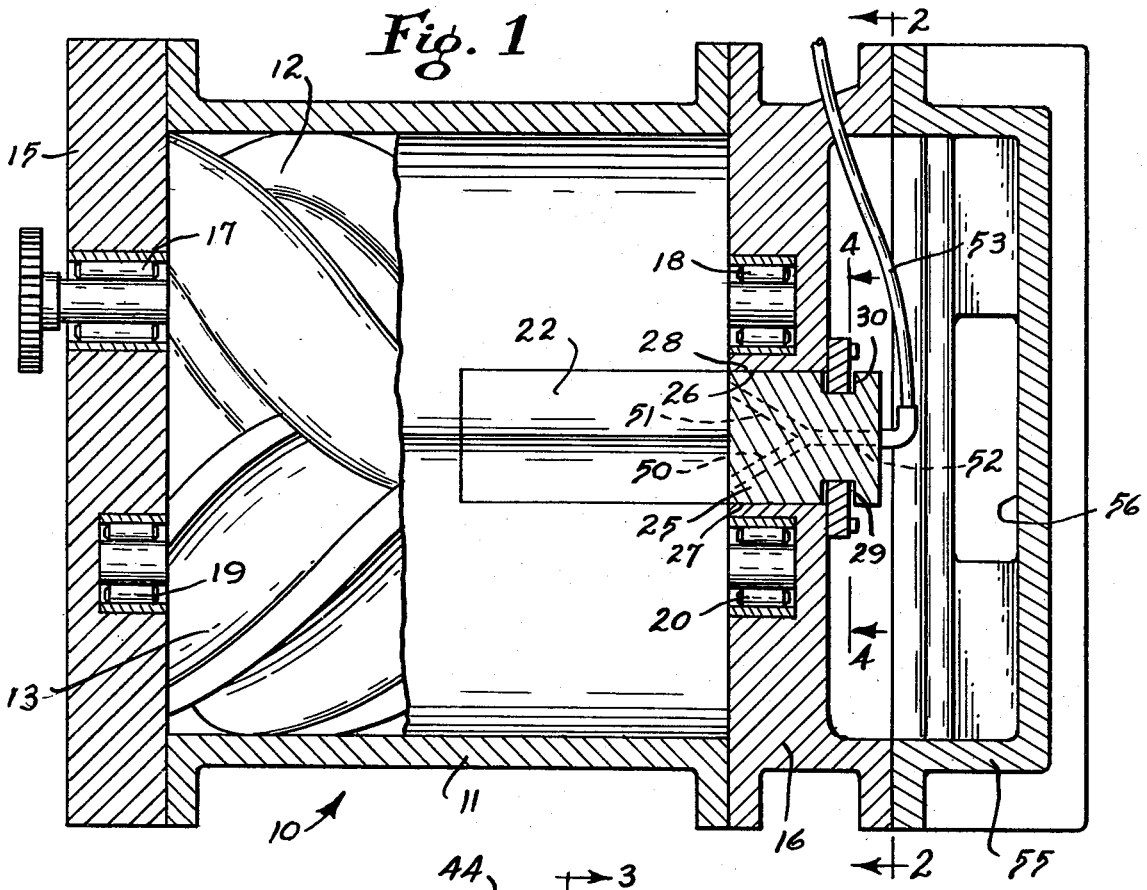
FIG. 1 is a horizontal sectional view through a screw type compressor in accordance with the present invention with portions broken away for clarity.

With further reference to the drawings, a compressor 10 in accordance with the present invention has outer wall structure 11 shaped to house a pair of intermeshing helical rotors or screws 12 and 13 which are mounted for rotation in bearing means mounted in low pressure end wall 15 and high pressure end wall 16, respectively. Rotor 12 is carried in bearing means 17 and 18 and rotor 13 in bearing means 19 and 20 in the respective end walls. An inlet passageway (not shown) is located at one end of the compressor adjacent to the low pressure end wall 15.

The compressor has a capacity control valve slide member 22, the upper portion of which is shaped in a conventional manner to form a portion of the wall at the bottom inner section of the rotors. The valve slide member 22 is shiftable from a closed position in which it closes the space beneath the rotors for at least a portion of the length thereof to an open position in which one end of the slide member extends forwardly beyond the high pressure end wall 16, thereby providing an opening at the opposite end which permits fluid between the threads of the rotors to return to the inlet passageway area before it has been compressed. Such capacity control, itself, is already known in the art and is particularly useful for providing an unloaded condition when the compressor is started. Operation of the slide can be accomplished by means well known in the art such as sensing the suction pressure and using the high pressure oil from the lubrication pump to cause the slide member to move toward open position at low suction pressure and toward closed position at high suction pressure. Such controls are illustrated in Wagneius U.S. Pat. Nos. 3,045,447 and Schibbye 3,314,597.

Figure 3:
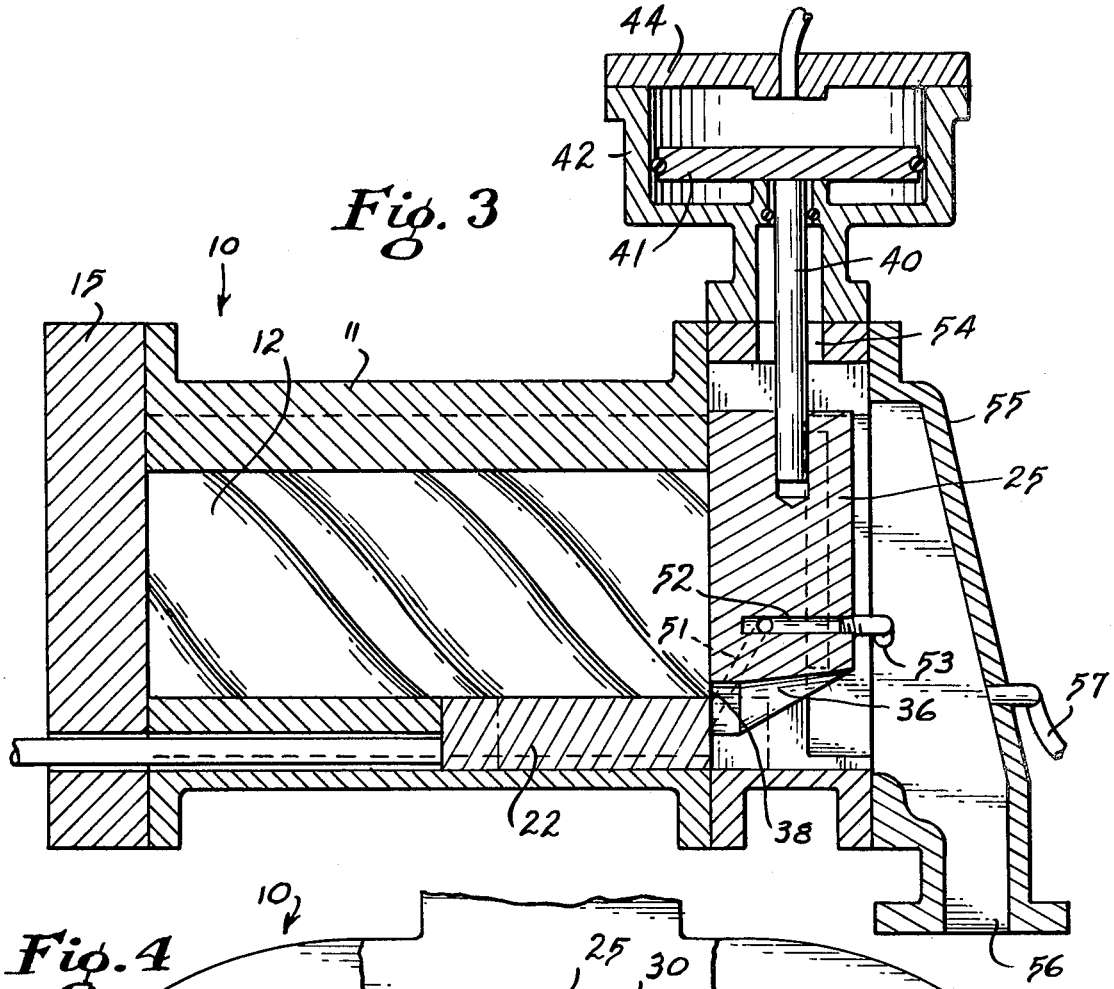
FIG. 3 is a sectional view taken on the line 3—3 of FIG. 2.

In order to control the pressure of the fluid being discharged at the high pressure end wall 16, such end wall is provided with a slide valve member 25 which is movable in a direction normal to the axes of the rotors and is slidably mounted in an opening 26 in the end wall 16. The slide valve member 25 has parallel sides 27 and 28 which are received in the opening 26 and has inset guide ways 29 and 30 which receive guide members 31 and 32 that are mounted by suitable fasteners 33 on the outer face of the end wall 16. As illustrated in FIGS. 1 and 3, the plane of the axes of the rotors 12 and 13 is horizontal and the inner face of the slide valve member 25 is mounted substantially co-planar with the inside face of the high pressure end wall 16 for movement in a vertical plane transverse to the horizontal plane of the axes of the rotors.

Figure 4:
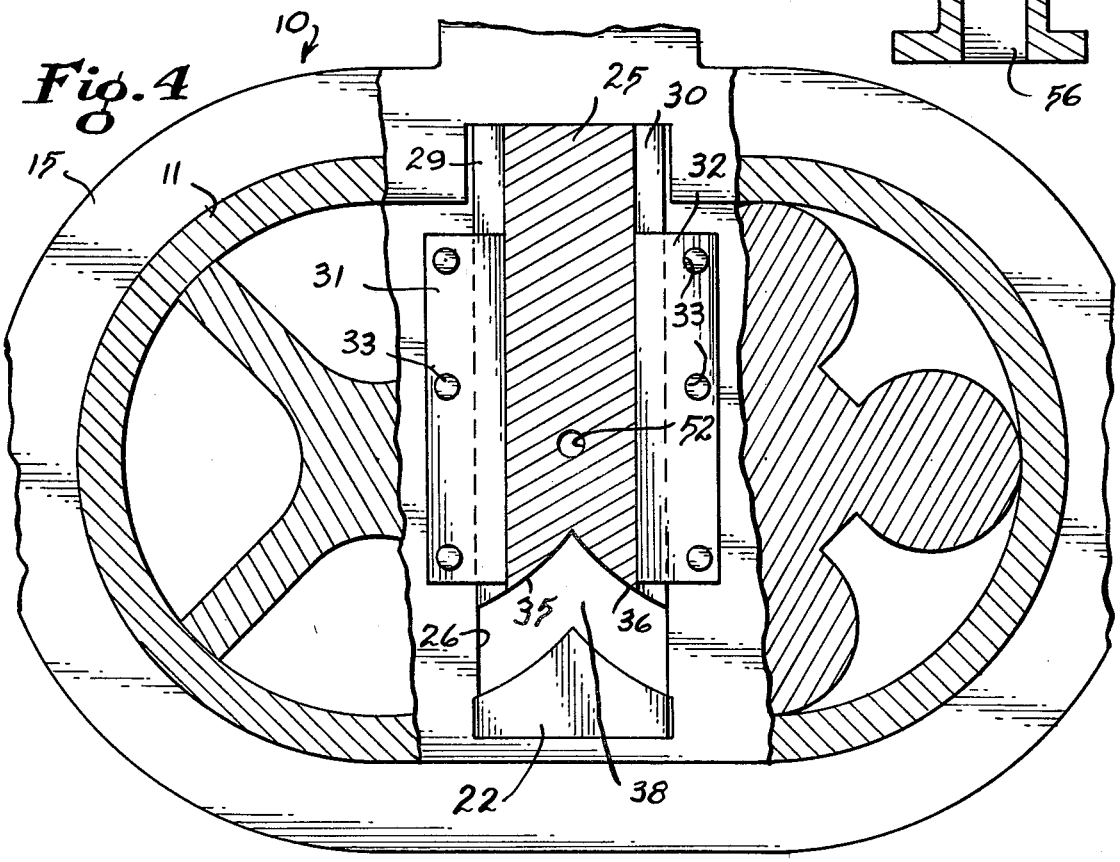
FIG. 4 is an enlarged fragmentary sectional view taken on the line 4—4 of FIG. 1 with portions broken away to show the rotors.

The lower end of the valve member 25 is substantially inverted V-shaped to provide inclined surfaces 35, 36 which in the lowermost position of the member 25 is spaced from and generally complementary to the upper surfaces of the horizontal slide member 22, the spacing therebetween in the lowermost position of the valve member 25 providing a discharge opening 38 of a predetermined minimum. In an upper position as indicated in FIG. 4, the opening 38 is a predetermined maximum.

Figure 2:
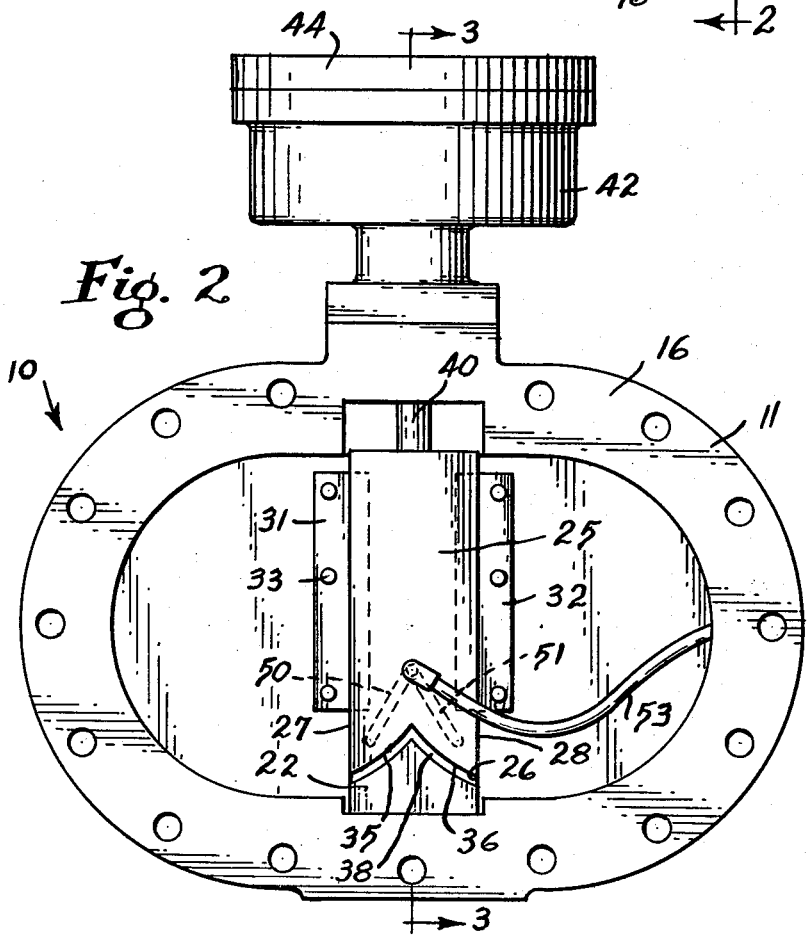
FIG. 2 is a sectional view taken on the line 2—2 of FIG. 1 and showing the high pressure end of the compressor.

With particular reference to FIGS. 2 and 3, the valve member 25 is attached to a connecting rod 40 which connects it to an operating piston 41 which is vertically movable within cylinder 42 and having head 44. The position of the valve member 25 is controlled automatically by controlling the position of the piston 41 as will be described.

In order to control the position of the piston 41 and hence the position of the slide valve member 25 in response to the discharging pressures of the fluid, the slide valve member 25 is provided with passageways 50, 51, 52 with the passageway 52 being connected to a conduit 53 leading to a differential pressure control monitoring system which will be described. The passageways 50, 51 communicate directly with the inner face of the valve member 25 and are in axial alignment with the fluid being compressed by the rotors 12 and 13.

The upper portion of the high pressure end wall 16 has a bore 54 through which the piston rod 40 extends. A discharge cover 55 is attached to the end wall 16 in any desired manner and such discharge cover has a discharge passageway 56 for fluid discharged from the compressor. The discharge cover 55 has a conduit 57 which communicates the discharge passageway 56 with the differential control monitoring system.

Figure 5:
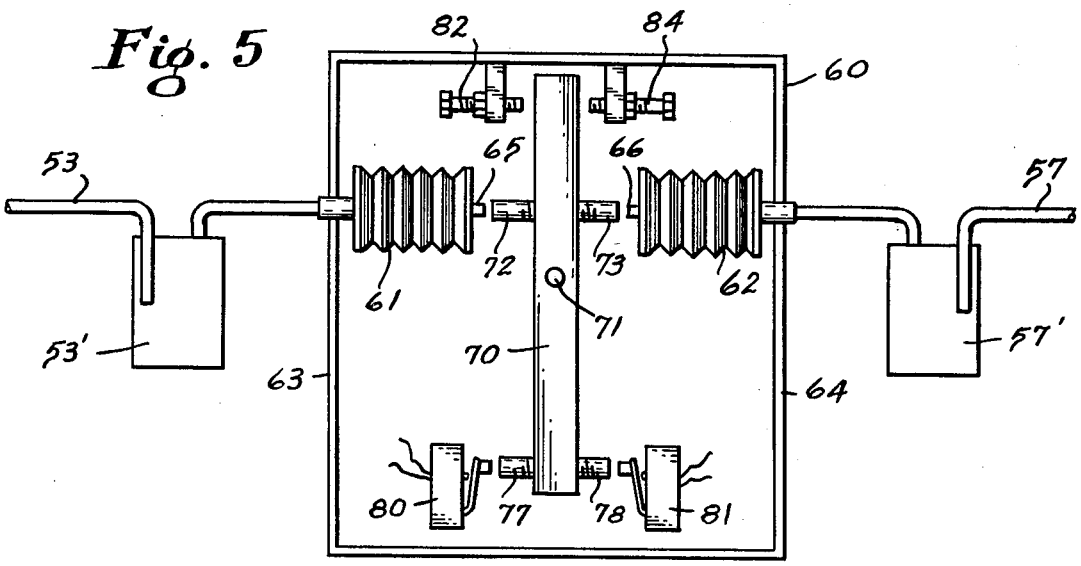
FIG. 5 is a schematic view of the mechanism for controlling the transversely movable valve member.
Figure 6:
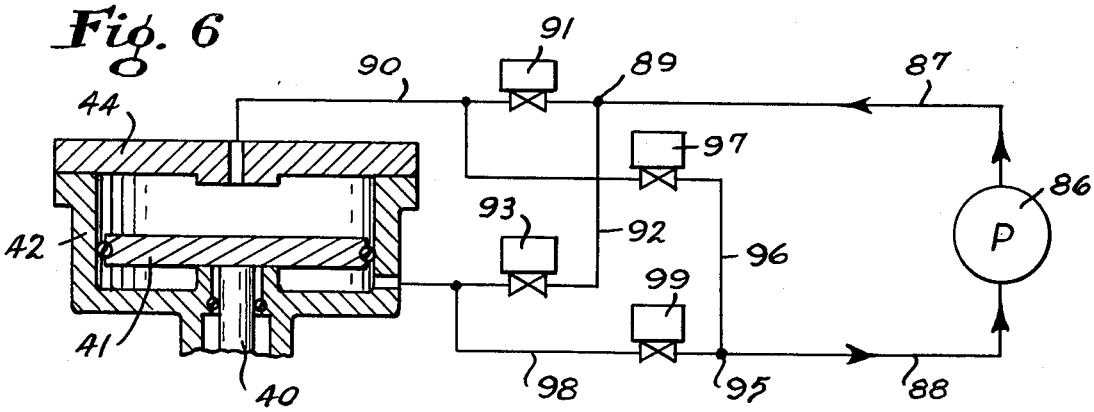
FIG. 6 is a schematic view of the pipe connections for controlling the transverse valve member.
Figure 7:
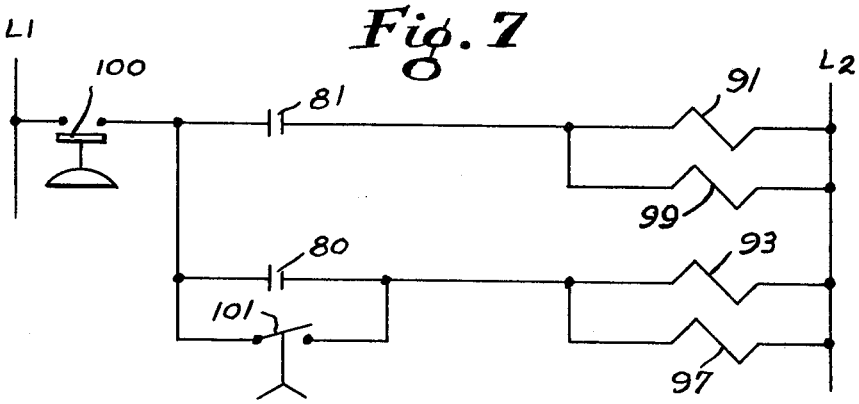
FIG. 7 is a schematic view of the electrical circuitry for controlling the transversely movable valve member.

Reference is now made to FIGS. 5, 6 and 7 for the details of the differential pressure control monitoring system. The system illustrated includes a rigid support member 60 having mounted thereon bellows 61 and 62, each being rigidly fixed to respective side walls 63 and 64 of the support member 60. The bellows are mounted opposite each other so as their free ends 65 and 66, respectively, may move toward and away from each other.

A pendulum 70 is rotatably mounted on a fixed pivot pin 71 carried by the support member 60. A pair of opposed adjustable engaging means 72 and 73 are mounted on the pendulum 70 substantially in alignment with the free ends 65 and 66 of the bellows and are positioned for close spacing (e.g., 0.001 inch to 0.003 inch) therefrom when the pendulum is in its central position. Another pair of adjustable engaging means 77 and 78 are mounted on the pendulum adjacent to the bottom end and are similarly positioned closely adjacent to the external operating points of a pair of microswitches 80 and 81 mounted on the support member 60. The microswitches are in normal open circuit position when the pendulum is in its central position.

Adjustable stops 82 and 84 are mounted at the top portion of the support member 60 and substantially in alignment with the upper end of the pendulum in order to limit the pendulum movement and thus prevent damage to the microswitches 80 and 81.

The control mechanism described is for the purpose of controlling the operating member for the piston 41, thereby controlling the position of the slide valve member 25. While various types of operating members might be employed, a preferred embodiment includes the use of the oil pump that is normally associated with a helical rotary compressor for the purpose of rotor sealing, lubrication and cooling, as well as providing the mode of power for the hydraulic operation of the capacity modulation slide valve 22, as is known in the art and described, e.g., in American Society of Heating, Refrigeration and Airconditioning Engineers, Inc. Handbook and Product Directory, 1979 Equipment, Chapter 12, pp 12.14–12.17. In FIG. 6, the oil pump is represented schematically and indicated by numeral 86 and has a discharge line 87 and return line 88. Discharge line 87 is connected at junction 89 to line 90, having solenoid valve 91 therein, to the head 44 for communication with the space above piston 41. Similarly, line 87 is connected via junction 89 to line 92, having solenoid valve 93 therein, to the space beneath the piston 41.

Return line 88 is connected by a junction 95 with line 96, having a solenoid valve 97, therein and connected to the line 90 for communication with the space above the piston head 41. Similarly, line 88 is connected by the junction 95 to line 98, having a solenoid valve 99 therein, for connection to the line 92 and communication with the space beneath the piston head 41.

A schematic of the electrical hookup appears in FIG. 7. Switch 100 is closed when the oil pump 86 builds up to a preliminary minimum operating pressure. A timing relay 101 is in the compressor starting circuit (not shown) and has a contact in parallel with the microswitch 80 and in series with the solenoid valves 93 and 97, thereby holding the discharge port control valve 25 fully open during compressor startup. Microswitch 81 is in series with solenoids 91 and 99 and in order to pressurize the top area of the cylinder head.

In the operation of the control system, after the compressor is started and the timing relay 101 is open, pressure at the discharge end of the compressor is sensed at the passageways 50, 51 and 52 and is transmitted by the conduit 53 through conventional oil separators 53' to the bellows 61. Simultantously, pressure from the discharge passageway 56 is transmitted by conduit 57 through an oil separator 57' to the bellows 62. If the pressure that is transmitted by conduit 53 is above that transmitted by conduit 57, this causes switch 80 and the circuits to the solenoids 93 and 97 to be closed, thereby energizing the corresponding valves and causing these to open and permit oil under pressure to enter the housing 42 under the piston 41 and permit oil relief above the piston 41, thereby causing the slide 25 to move upwardly and increase the discharge port opening 38.

When the pressure as sensed in the conduit 53 is lower than that sensed in conduit 57, this reverses the operation and causes closing of the circuit through microswitch 81 and solenoid valves 91 and 99, thereby applying increased pressure to the top of the piston 41 and relieving the pressure therebeneath, thus causing the valve member 25 to move downwardly and thereby reduce the size of the discharge opening 38.

I claim:

1. In a screw compressor having meshing helical rotors on parallel axes and mounted in a housing having intersecting cylindrical bores, a high pressure end wall to one end of said housing and a low pressure end wall at the other end thereof, the low pressure end wall having an inlet opening for the inlet of the compressor and the high pressure end wall having an internal face in alignment with and exposed to the cylindrical bores and an enclosed discharge area beyond the discharge opening and remote from the internal face of the high pressure end wall, the improvement comprising, a discharge opening in the high pressure end wall, said discharge opening being generally aligned with the flow of fluid being compressed within the compressor, a slide member slidably moveable in said opening so as to be transversely moveable with respect to the axes of the rotors and which in a first position closes said discharge opening to a predetermined minimum and in a second position opens the discharge opening to a predetermined maximum, said slide member being moveable between said positions to provide openings of varying size therebetween, and means for controlling the position of the slide member, said controlling means including first sensing means for sensing the pressure of the working fluid at the internal face of the high pressure end wall, said first sensing means being positioned in the high pressure end wall so as to be generally axially aligned with the fluid being compressed within the cylindrical bores, second sensing means for sensing the pressure of the working fluid in the discharge area beyond the discharge opening and said slide member, and means for moving said slide member in response to a functional difference between the sensed pressures, whereby the sensed pressures are maintained substantially equal.

2. The invention of claim 1 including an elongated opening extending substantially along the length of the rotors, a second slide member mounted in said elongated opening so as to be movable generally parallel to the rotors, one end portion of said second slide member cooperating with said first slide member to define the size of said discharge opening from said housing, and means for controlling the operation of said second slide member and said discharge opening being generally equally spaced between the axis of the rotors.

3. The invention of claim 1 in which said first sensing means includes at least one passageway which extends through said slide member from said internal face of said high pressure end wall, said passageway being generally disposed in the direction of the fluid being compressed, so as to be generally aligned with the direction in which the fluid is being compressed, first conduit means connecting said passageway to said means for moving said slide member, and said second sensing means includes second conduit means connecting said second sensing means to said means for moving said slide member.

4. In a screw compressor having meshing helical rotors on parallel axes and mounted in a housing having a high pressure end wall at one end and a low pressure end wall at the other end, the inner face of said high pressure end wall being normal to the flow path of the working fluid being compressed in said compressor, a discharge cover mounted on said high pressure end wall remote from said inner face, and said discharge cover including a discharge passageway, the improvement comprising said high pressure end wall having an elongated open which extends perpendicular to the axis of the rotors and generally equally spaced between the axis of each rotor, a slide valve member being substantially coplanar with the inner face of said high pressure end wall, one end of said slide valve member cooperating with said housing to define a discharge opening for the fluid being compressed within said housing, said discharge opening being generally aligned with the flow of the fluid being compressed within the compressor, means for moving said slide valve member along said opening from a first position defining a minimum discharge opening to a second position defining a maximum discharge opening, said slide valve member being movable selectively between said first and second positions to provide varying sizes of discharge openings, first sensing means opening in the inner face of said slide valve member for sensing the pressure of the fluid at said high pressure end wall of said housing, second sensing means communicating with said discharge passageway for sensing the pressure therein, control means connected to said first and second sensing means, and said control means operating said means for moving said slide valve member in response to a functional difference in pressures at said first and second sensing means, whereby said slide valve member is moved to vary the size of the discharge opening from said housing so that the pressures on opposite sides of the discharge opening are substantially equal.

* * * * *